US009610625B2

(12) United States Patent
Meliga

(10) Patent No.: US 9,610,625 B2
(45) Date of Patent: Apr. 4, 2017

(54) BENDING MACHINES FOR BENDING PROFILES, METAL SHEETS AND THE LIKE

(71) Applicant: Mauro Meliga, Leini' (IT)

(72) Inventor: Mauro Meliga, Leini' (IT)

( * ) Notice: Subject to any disclaimer, the term of this patent is extended or adjusted under 35 U.S.C. 154(b) by 0 days.

(21) Appl. No.: 14/419,676

(22) PCT Filed: Aug. 6, 2013

(86) PCT No.: PCT/IB2013/056436

§ 371 (c)(1),
(2) Date: Feb. 5, 2015

(87) PCT Pub. No.: WO2014/024133

PCT Pub. Date: Feb. 13, 2014

(65) Prior Publication Data

US 2015/0224554 A1 Aug. 13, 2015

(30) Foreign Application Priority Data

Aug. 7, 2012 (IT) ..... TO2012A000710

(51) Int. Cl.
*B21D 5/14* (2006.01)
*B21D 5/12* (2006.01)
(Continued)

(52) U.S. Cl.
CPC ..... *B21D 5/14* (2013.01); *B21D 5/12* (2013.01); *B21D 7/08* (2013.01); *B21D 37/04* (2013.01); *B21D 37/06* (2013.01)

(58) Field of Classification Search
CPC ... B21D 5/06; B21D 5/08; B21D 5/12; B21D 7/08; B21D 11/20; B21D 37/04; B21D 37/06
(Continued)

(56) References Cited

U.S. PATENT DOCUMENTS 2,995,171 A 8/1961 Hausler
4,796,449 A * 1/1989 Berne ..... B21D 5/14 72/10.1
2010/0089114 A1* 4/2010 Boldrini ..... B21D 5/14 72/249

FOREIGN PATENT DOCUMENTS

EP 0919302 A2 6/1999
EP 2433720 A1 3/2012
(Continued)

*Primary Examiner* — David B Jones
(74) *Attorney, Agent, or Firm* — Robert E. Alderson Jr.

(57) ABSTRACT

Machines for bending profiles, metal sheets and the like are provided. Such machines include those having a structure or frame and a bending device with three rollers. The axis ($x_1$) of the first roller is fixed relative to the structure or frame, while the axes ($x_2$, $x_3$) of the second and third rollers are movable relative to each other, and hence each relative to the axis ($x_1$) of the first roller, so as to define a curved path with an adjustable radius of curvature along which the material to be bent is caused to move passing between said rollers. The bending device may further include an adjustment mechanism for adjusting the position of the axes ($x_2$, $x_3$) of the second and third rollers with two degrees of freedom. The adjustment mechanism may include a pair of tilting arms hinged to the structure or frame so as to tilt about respective fixed axes of rotation ($x_4$, $x_5$) oriented parallel to the axes ($x_1$, $x_2$, $x_3$) of the three rollers. The axes ($x_2$, $x_3$) of the second and third rollers may be guided each by a respective tilting arm along a respective direction of translation ($y_1$, $y_2$) which is fixed relative to that tilting arm.

4 Claims, 5 Drawing Sheets

(51) Int. Cl.
*B21D 37/04* (2006.01)
*B21D 7/08* (2006.01)
*B21D 37/06* (2006.01)

(58) Field of Classification Search
USPC ..... 72/173
See application file for complete search history.

(56) References Cited

FOREIGN PATENT DOCUMENTS

| | | | |
|---|---|---|---|
| JP | 2003211226 | A | 7/2003 |
| WO | 2008102388 | A1 | 8/2008 |

* cited by examiner

BENDING MACHINES FOR BENDING PROFILES, METAL SHEETS AND THE LIKE

CROSS-REFERENCE TO RELATED APPLICATIONS

This application is a National Phase Application of PCT International Application No. PCT/IB2013/056436, International Filing Date, Aug. 6, 2013, claiming priority to Italian Patent Application No. TO2012A000710, filed Aug. 7, 2012, each of which is hereby incorporated by reference in its entirety.

FIELD OF THE INVENTION

The present invention relates in general to a bending machine for bending profiles, metal sheets and the like, and more specifically to a bending machine of the type comprising three rollers with parallel axes, that can be moved relative to each other so as to define a curved path having the desired radius of curvature, the material to be bent (be it a profile or a metal sheet) being caused to move along this curved path passing between the three rollers.

BACKGROUND OF THE INVENTION

In the bending machines of the above-identified type the three rollers are set into rotation at the same angular speed, each about its own axis of rotation coinciding with its own geometric axis. Typically, the position of the axis of one of the three rollers (hereinafter referred to as "the stationary roller") is fixed, whereas the axes of the other two rollers (hereinafter referred to as "the movable rollers") can be moved with respect to each other and each with respect to the axis of the stationary roller to change the radius of curvature of the curved path imposed to the material to be bent. In this connection, there are various ways to change the relative position of the axes of the rollers.

For example, in the bending machine known from EP0919302 each of the two movable rollers is supported on a respective tilting arm which is actuated by a respective hydraulic actuator or cylinder to tilt about a stationary axis of rotation. Such a known solution does not allow to adjust the relative position of the axes of the rollers in a wide range, since the axis of each movable roller can be moved only along an arc of circumference the centre of which coincides with the tilting centre of the respective tilting arm.

WO2008/102388 also describes the possibility of displacing the axis of rotation of each of the two tilting arms along a vertical direction. To this end, each of the two tilting arms is hinged to the nut of a screw and nut linear actuation device, the screw of which has its own axis oriented vertically. If on the one hand this further known solution allows a wider range of adjustment of the relative position of the axes of the rollers, since it offers the degree of freedom of translation of the axis of rotation of each tilting arm in addition to the degree of freedom of rotation of the tilting arms, on the other hand it has a reduced stiffness, since the tilting arms are not hinged to structural parts of the machine, but to actuation devices which are clearly not able to provide a support having such a stiffness as that of a structural part of the machine. Such a known solution for adjusting the position of the axes of the rollers cannot therefore be used on large-size bending machines, which are required to apply high bending forces.

SUMMARY OF THE INVENTION

It is therefore an object of the present invention to provide a bending machine of the above-identified type, which allows to adjust the relative position of the axes of the rollers in a wide range of relative positions and which can also be used for bending operations that require to apply considerably high forces, such as for example bending of high-thickness metal sheets or bending of large-section profiles. This and other objects are fully achieved according to the present invention by virtue of bending machines having features described and claimed herein.

In short, the invention is based on the idea of slidably supporting each of the two movable rollers on a respective tilting arm and of hinging each tilting arm to the structure of the machine about a respective stationary axis of rotation. The axis of each movable roller can therefore be rotated, along with the respective tilting arm, about the axis of rotation of this latter and displaced along a straight direction that is fixed relative to the respective tilting arm. This provides the bending machine with high flexibility of use. Moreover, by virtue of the movable rollers being supported by tilting arms hinged to the structure of the machine about respective stationary axes of rotation, the bending machine according to the invention can be used also for applications that require high bending forces. A further advantage is that the bending machine according to the invention can be disassembled into three pieces, namely the stationary roller with the respective support structure and the two movable rollers with the respective tilting arms and the respective actuation devices, and is thus easy to transport even in case of large size. Further features and advantages of the invention will become clear from the following detailed description, given purely by way of non-liming examples with reference to the attached drawings.

DETAILED DESCRIPTION

Figure 1:
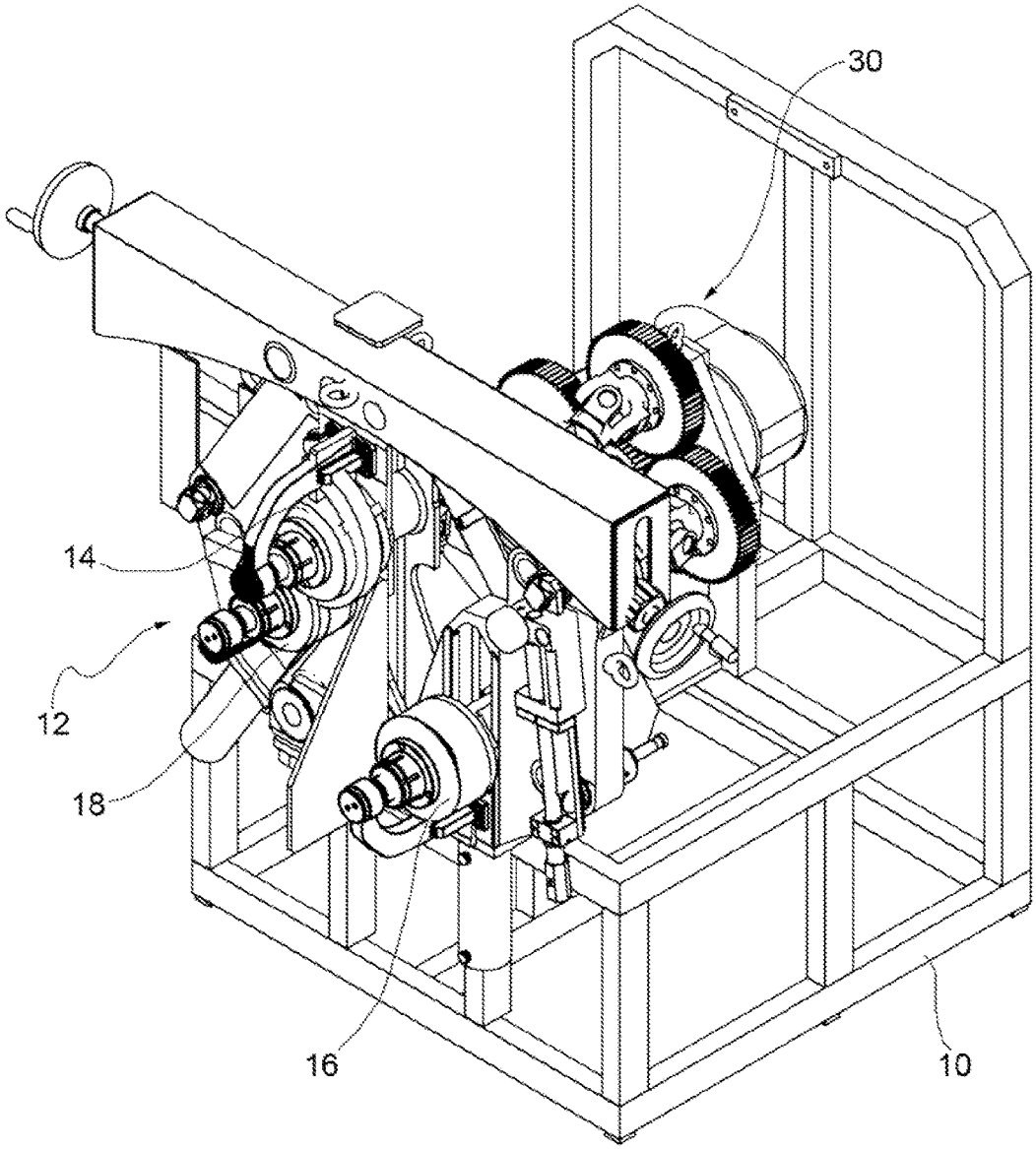
FIGS. 1 and 2 are perspective views, from different points of view, of a bending machine according to an embodiment of the present invention, from which the outer casing has been removed to allow to see the adjustment mechanism for adjusting the position of the rollers.
Figure 2:
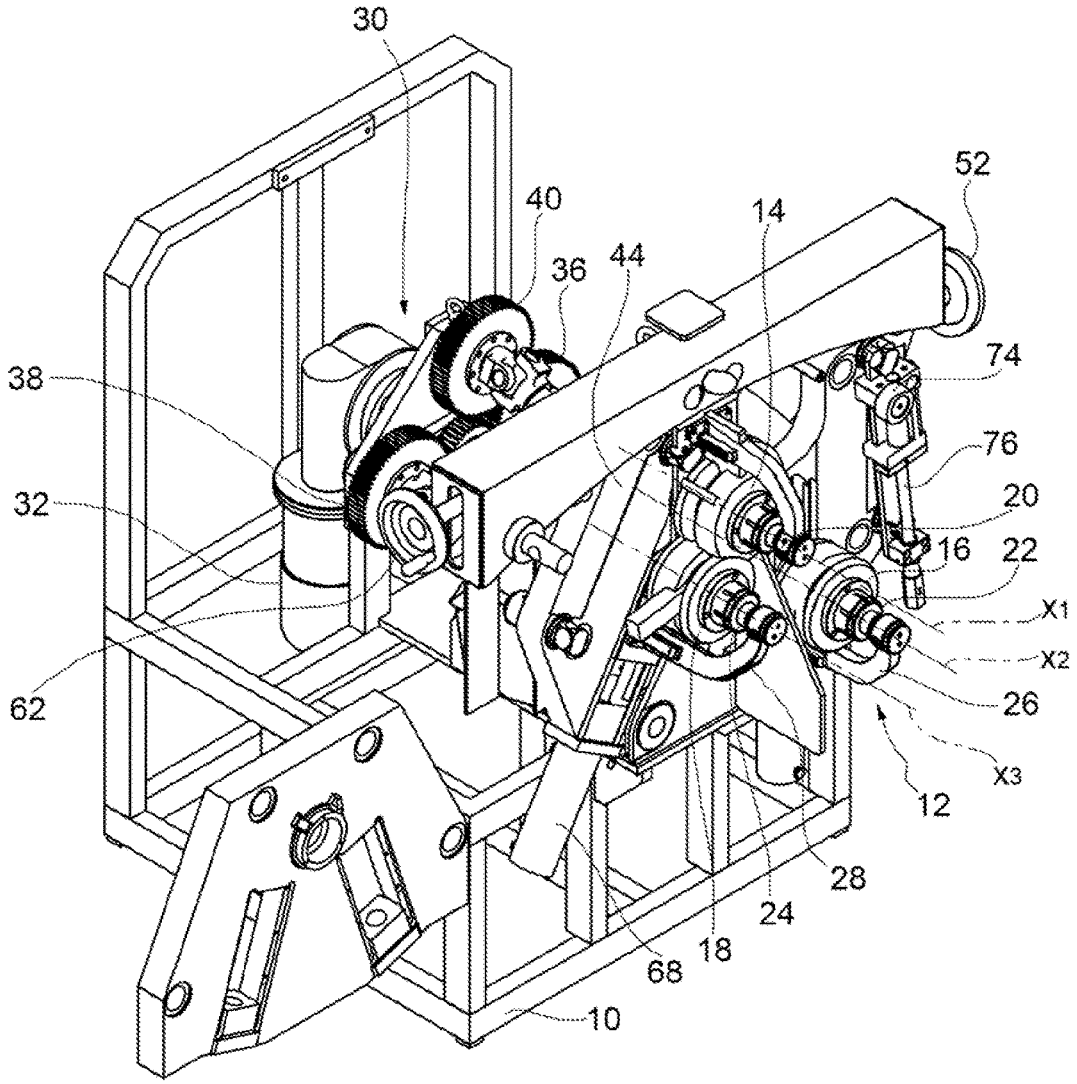
Figure 3:
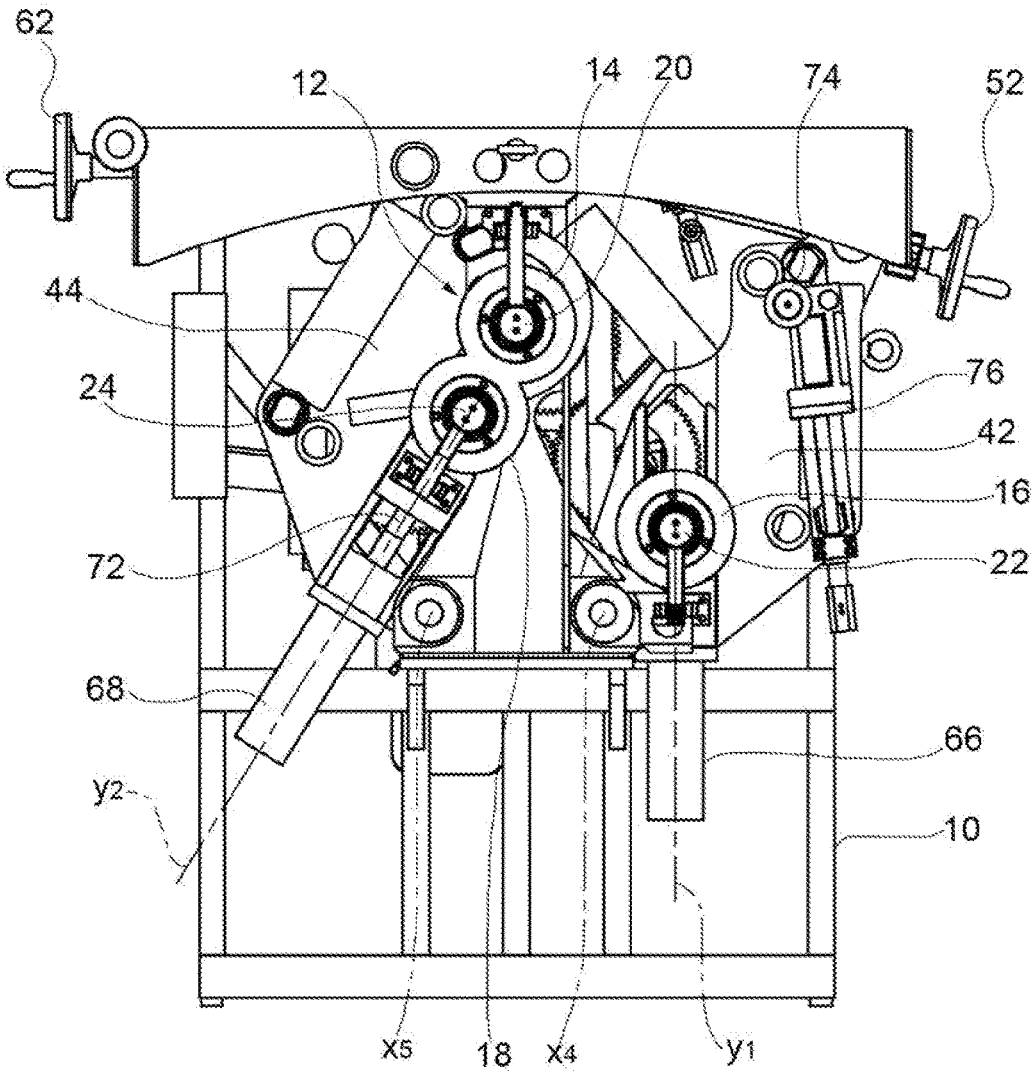
FIG. 3 is a side elevation view of the bending machine of FIGS. 1 and 2.
Figure 4:
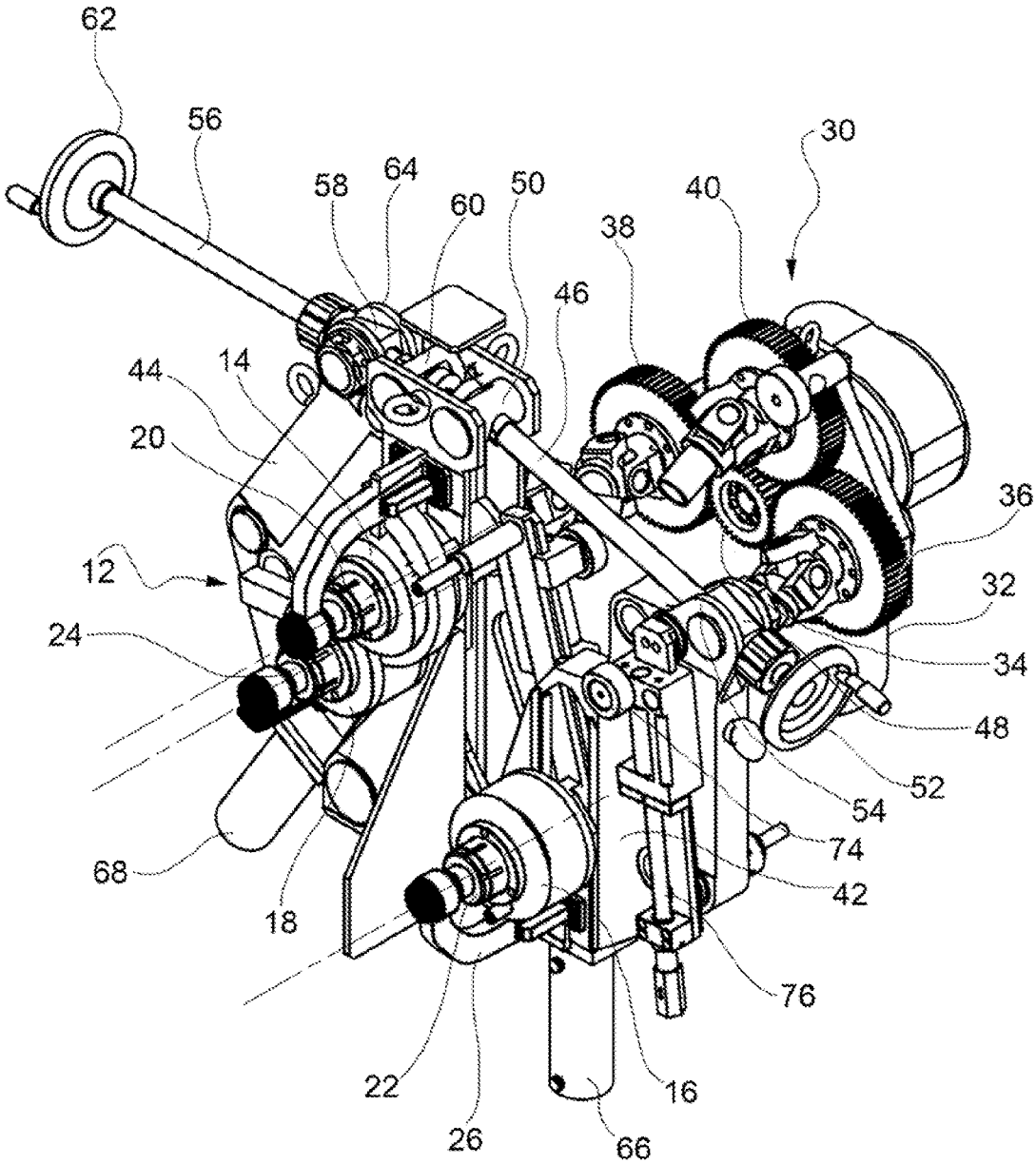
FIGS. 4 and 5 are a front perspective view and a rear perspective view, respectively, of the adjustment mechanism for adjusting the position of the rollers of the bending machine of FIGS. 1 and 2.
Figure 5:
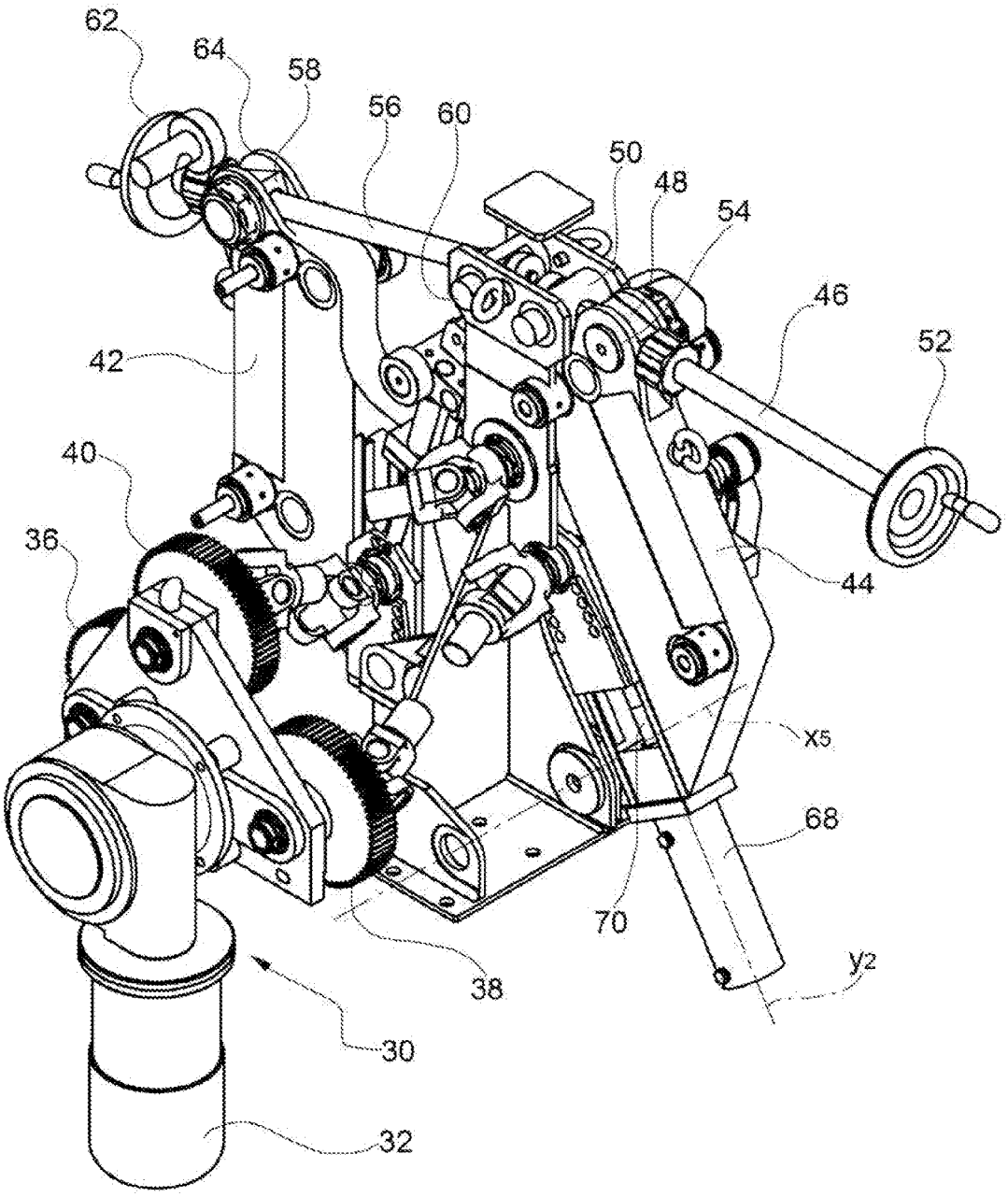

With reference to the drawings, a bending machine according to an embodiment of the present invention basically comprises a structure or frame generally indicated 10 and a bending device generally indicated 12. The bending machine illustrated in the drawings is designed in particular to bend profiles. The invention is however also applicable to bending machines designed to bend metal sheets, as will be better explained in the following part of the description.

The bending device 12 comprises three rollers with horizontal axes, namely a first roller (or stationary roller) 14, the axis of which is indicated $x_1$, and a pair of second rollers (or movable rollers) 16 and 18, the axes of which are indicated $x_2$ and $x_3$, respectively. The stationary roller 14 is mounted on a shaft 20 supported in a fixed position by the structure 10. The position of the axis $x_1$ of the stationary roller 14 is therefore fixed. More specifically, the axis $x_1$ of the stationary roller 14 is placed in a top area of the machine, substantially in the vertical middle plane of the machine. The movable rollers 16 and 18 are mounted on respective shafts 22 and 24 supported on respective movable bearings 26 and 28, whereby the positions of the axes $x_2$ and $x_3$ of these rollers can be changed independently of each other. More specifically, the position of each of the two axes $x_2$ and $x_3$ can be varied with two degrees of freedom in a vertical plane perpendicular to these axes, while remaining below the position of the axis $x_1$ and on both sides of the vertical plane (middle plane) passing through the axis $x_1$. The positions of the three axes $x_1$, $x_2$ and $x_3$ define therefore the vertices of a triangle the shape and size of which vary depending on the positions of the axes $x_2$ and $x_3$, but the top vertex of which remains fixed on the axis $x_1$.

The bending device 12 further comprises a motor unit 30 adapted to set the three rollers 14, 16 and 18 into rotation at the same angular speed about the respective axes of rotation $x_1$, $x_2$ and $x_3$. In the embodiment shown in the drawings the motor unit 30 comprises an electric motor 32, a pinion 34 with horizontal axis that is set into rotation directly by the electric motor 32, if necessary via a reduction gear or an angle gear arranged in between, a first gearwheel 36 meshing with the pinion 34 and torsionally coupled by means of a cardan shaft (not shown) with the shaft 22 carrying the movable roller 16, a second gearwheel 38 meshing with the pinion 34 and torsionally coupled by means of a cardan shaft (not shown) with the shaft 24 carrying the movable roller 18, and a third gearwheel 40 meshing with one of the two gearwheels 36 or 38 (in the illustrated example with the gearwheel 36) and torsionally coupled by means of a cardan shaft (not shown) with the shaft 20 carrying the stationary roller 14. The gearwheels 36, 38 and 40 have the same number of teeth and therefore rotate at the same angular speed. Accordingly, the rollers 14, 16 and 18, which are set into rotation by the gearwheels 36, 38 and 40 by means of the respective cardan shafts, also rotate at the same angular speed. The use of cardan shafts for connecting the gearwheels with the shafts on which the rollers are mounted clearly allows to transmit the motion to the movable rollers even though the position of these latter is not fixed, but can be changed depending on the type of bending to be carried out. However, the motor unit might be different from the one shown in the drawings, for example (in particular in case of large-size machines) it might comprise, for each of the three rollers, a respective hydraulic reduction motor.

The bending device 12 further comprises an adjustment mechanism for adjusting the position of the axes $x_2$ and $x_3$ of the movable rollers 16 and 18. The adjustment mechanism comprises a pair of tilting arms 42 and 44 hinged at a lower portion thereof to the structure 10 of the machine so as to tilt about respective stationary axes of rotation, indicated $x_4$ and $x_5$, respectively, which are oriented parallel to the axes $x_1$, $x_2$ and $x_3$ of the rollers 12, 14 and 16 and are placed near the middle vertical plane of the machine. The bearing 26 associated to the shaft 20 carrying the movable roller 16 is mounted on the tilting arm 42 so as to be movable along an axis $y_1$ which is fixed relative to that arm. Likewise, the bearing 28 associated to the shaft 22 carrying the movable roller 18 is mounted on the tilting arm 44 so as to be movable along an axis $y_2$ which is fixed relative to that arm. The position of each of the axes $x_z$ and $x_3$ of the movable rollers 16 and 18 can thus be adjusted with two degrees of freedom, namely a degree of freedom of rotation about the respective axis $x_4$ or $x_5$, given by the tilting movement of the respective tilting arm 42 or 44 about that axis, and a degree of freedom of translation along the respective axis $y_1$ or $y_2$. Moreover, the position of the axis $x_2$ can be adjusted independently of the position of the axis $x_3$.

The tilting movement of the tilting arms 42 and 44 about the respective axes of rotation $x_4$ and $x_5$ can be driven in various ways. For example, in the embodiment proposed herein the tilting arms 42 and 44 can be actuated by means of respective screw and nut mechanisms.

More specifically, the tilting arm 42 can be actuated by means of a screw and nut mechanism comprising a screw 46 and a nut 48 in which the screw 46 engages. The screw 46 is hinged at its end facing towards the middle vertical plane of the machine, for example by means of a hinge pin 50, in a point which is fixed relative to the structure 10 of the machine and can be set into rotation about its own axis for example by means of a wheel 52 secured to its opposite end. The nut 48 is hinged to the tilting arm 42, for example at a fork-like connection portion 54 drivingly connected to that arm, whereby movement of the nut 48 in either direction along the axis of the screw 46 resulting from rotation of that screw causes the tilting arm 42 to tilt in either direction about the axis of rotation $x_4$. Likewise, the tilting arm 44 can be actuated by means of a screw and nut mechanism comprising a screw 56 and a nut 58 in which the screw 56 engages. The screw 56 is hinged at its end facing towards the middle vertical plane of the machine, for example by means of a hinge pin 60, in a point which is fixed relative to the structure 10 of the machine and can be set into rotation about its own axis for example by means of a wheel 62 secured to its opposite end. The nut 58 is hinged to the tilting arm 44, for example at a fork-like connection portion 64 drivingly connected to that arm, whereby movement of the nut 58 in either direction along the axis of the screw 56 resulting from rotation of that screw causes the tilting arm 44 to tilt in either direction about the axis of rotation $x_5$.

The translational movement of each of the two movable bearings 26 and 28 along the respective axes $y_1$ and $y_2$ is controlled by means of a respective linear actuator, indicated 66 for the movable bearing 26 and 68 for the movable bearing 28. The linear actuator may for example be an electro-mechanical actuator comprising an electric motor adapted to generate a rotary motion and a motion conversion mechanism (such as for example a screw and nut mechanism) adapted to convert the rotary motion generated by the electric motor into a translational motion of an output member (indicated 70 for the linear actuator 66 and 72 for the linear actuator 68). The movable bearing 26 is drivingly connected to the output member 70, while the movable bearing 28 is drivingly connected to the output member 72.

The bending device 12 further comprises, in per-se-known manner, a pair of lateral corrector rollers 74 (only one of which is shown in the drawings). In this case, each lateral corrector roller 74 is carried by a respective tilting arm 42, 44 and is movable, by means of a respective linear actuator 76, along a respective straight direction that is fixed relative to the respective tilting arm. Naturally, the principle of the invention remaining unchanged, the embodiments and the constructional details may vary from those described and illustrated purely by way of non-limiting example, without thereby departing from the scope of the invention as described and claimed herein.

For example, as already mentioned above, even though the bending machine according to the invention is described and illustrated herein with reference to its application to the bending of profiles, it is equally applicable to the bending of metal sheets (the so-called calendering). In case of a bending machine designed to bend metal sheets, adjustment of the position of the axes of the two side rollers will of course be carried out in the same way as that described above, i.e. with a first rotational degree of freedom provided by the oscillation of a pair of tilting arms hinged to the structure of the machine and with a second degree of freedom provided by the translation of the axis of each movable roller along a straight direction that is fixed relative to the respective tilting arm, and only the way the rollers are shaped and the way the rollers are supported will change. The rollers will have, in fact, a length (axial size) larger than that of rollers adapted to the bending of profiles and will have therefore to be supported at both their axial ends. To this end, two adjustment mechanisms similar to the one described above may be provided for, each of which may include a pair of tilting arms arranged to support each a respective end of a respective movable roller and actuating devices for controlling the rotation of the tilting arms and the translation of the bearings of the movable rollers along the respective tilting arms. In this connection, since the two adjustment mechanisms are controllable independently of each other, it will be possible to cause the two movable rollers to take an orientation such that the respective axes are inclined relative to each other, and hence each relative to the axis of the stationary roller, in order to obtain a conical bending of the metal sheet.

The invention claimed is:

1. A bending machine comprising a frame and a bending device, the bending device comprising three rollers, namely a first roller having an axis ($x_1$) that is fixed relative to the frame and second and third rollers having respective axes ($x_2$, $x_3$) that are movable relative to each other, and hence each relative to the axis ($x_1$) of the first roller, so as to define a curved path with an adjustable radius of curvature along which a material to be bent is caused to move passing between said rollers, the bending device further comprising movable bearings supporting respective shafts on which the second and third rollers are mounted, the bending device further comprising an adjustment mechanism for adjusting the position of the axes ($x_2$, $x_3$) of the second and third rollers with two degrees of freedom, the adjustment mechanism comprising a pair of tilting arms hinged to the frame so as to tilt about respective axes of rotation ($x_4$, $x_5$) that are oriented parallel to each other and are fixed relative to the frame, and first adjustment elements for adjusting the angular position of the tilting arms about the respective axes of rotation ($x_4$, $x_5$), said movable bearings being mounted on the tilting arms to tilt with the tilting arms about the respective axes of rotation ($x_4$, $x_5$), wherein the axes ($x_2$, $x_3$) of the second and third rollers are each guided by a respective tilting arm along a respective direction of translation ($y_1$, $y_2$) which is fixed relative to said respective tilting arm, and wherein the adjustment mechanism further comprises second adjustment elements for adjusting the linear position of the axes ($x_2$, $x_3$) of the second and third rollers along the respective directions of translation ($y_1$, $y_2$).

2. The bending machine of claim 1, wherein said first adjustment elements comprise a pair of screw and nut mechanisms, each associated with a respective tilting arm so as to allow adjustment of the angular position of the tilting arms about the respective axes of rotation ($x_4$, $x_5$) independently of each other.

3. The bending of claim 1, wherein said second adjustment elements comprise a pair of linear actuators each carried by a respective tilting arm and each associated with one of said second and third rollers so as to allow adjustment of the linear position of the axes ($x_2$, $x_3$) of said rollers along the respective directions of translation ($y_1$, $y_2$) independently of each other.

4. The bending machine of claim 1, wherein the bending device further comprises a pair of lateral corrector rollers, each of which is carried by a respective tilting arm and is movable along a respective straight direction which is fixed relative to the respective tilting arm.

* * * * *